US005803192A

United States Patent [19]

Holte

[11] Patent Number: 5,803,192

[45] Date of Patent: Sep. 8, 1998

[54] DRILL BIT RETAINER FOR A DOWN HOLE HAMMER ASSEMBLY

[76] Inventor: Ardis L. Holte, 181 Polk St., Eugene, Oreg. 97402

[21] Appl. No.: 645,284

[22] Filed: May 13, 1996

[51] Int. Cl.[6] ..... E21B 4/14

[52] U.S. Cl. ..... 175/296; 175/415

[58] Field of Search ..... 175/296, 414, 175/415, 417

[56] References Cited

U.S. PATENT DOCUMENTS

| | | | |
|---|---|---|---|
| 2,947,519 | 8/1960 | Feucht | 175/296 |
| 3,322,216 | 5/1967 | Kurt | 175/414 |
| 4,706,764 | 11/1987 | Hughes | 175/415 X |
| 4,962,822 | 10/1990 | Pascale | 175/415 X |
| 5,154,244 | 10/1992 | Elsby et al. | 175/296 |
| 5,207,283 | 5/1993 | Lay | 175/296 |
| 5,390,749 | 2/1995 | Lyon | 175/296 |

*Primary Examiner*—Hoang C. Dang
*Attorney, Agent, or Firm*—Marger, Johnson, McCollom & Stolowitz, P.C.

[57] ABSTRACT

A down hole hammer assembly for percussive drilling of ground holes has a drill bit slidably carried in a chuck housed within a barrel of the assembly. Drill bit travel is limited by a retainer sleeve in place about a reduced segment of the drill bit. The sleeve includes a ring portion limiting bit travel and a skirt portion for confinement within a component of the hammer assembly to prevent loss of the retainer sleeve and drill bit during barrel separation.

3 Claims, 2 Drawing Sheets

DRILL BIT RETAINER FOR A DOWN HOLE HAMMER ASSEMBLY

BACKGROUND OF THE INVENTION

The present invention pertains to percussive drilling equipment for boring holes in earthen material.

Drill bits used in boring ground holes are part of down hole hammer assemblies. The drill bit is confined for limited axial movement in the hammer assembly by a split ring retainer. Such split ring retainers are held in place, initially by an elastic ring during hammer assembly and subsequently the split ring retainer is confined by the inner wall of the hammer barrel to maintain ring-to-bit engagement.

During certain operations performed with a down hole hammer, as for example, during use of an eccentric underreamer, it may be necessary to reverse drill pipe rotation. As the barrel is in threaded engagement with a drill bit chuck the barrel may be momentarily retracted away from the chuck and away from the split ring retainer to expose the latter. More often than not the elastic ring about the retainer has failed and permits the retainer, formed in halves, to fall away out of engagement with the bit which in turn results in loss of the bit with the bit being left in the hole when the hammer is extracted. Such loss of a bit is costly from a retrieval and cost standpoint. As the use of eccentric underreamers becomes more common this problem of bit loss now occurs frequently. Other boring operations can require counterclockwise rotation of a hammer which, if the drill bit is stuck, will result in unscrewing of the hammer chuck from the hammer barrel to expose the split retainer ring with resulting loss of the ring and the drill bit.

SUMMARY OF THE PRESENT INVENTION

The present invention is embodied in an improved down hole hammer assembly with a novel drill bit retainer not readily susceptible to loss upon exposure of the retainer during momentary unscrewing of the hammer barrel from a drill bit chuck.

The present retainer includes a skirt portion which nests within associated hammer structure. Accordingly the skirt portion is confined against separation to maintain ring configuration regardless of a hammer barrel being momentarily removed from about the drill bit retainer. Upon clockwise drill pipe rotation the hammer is returned to its original configuration.

Important objectives of the present invention include the prevention of drill bit loss during a drilling operation by preventing the loss of a drill bit retainer from about the drill bit; the prevention of the loss of a drill bit retainer and consequent loss of the bit during a drilling operation by a novel retainer so as to be confined about the drill bit regardless of exposure of the retainer during barrel uncoupling and retraction upwardly past said retainer; the provision of a combination split ring retainer and skirt for placement about a drill bit with the retainer confined about the bit without reliance on heretofore used fragile resilient rings in place about a split ring retainer, which rings are highly susceptible to failure.

DETAILED DESCRIPTION OF THE PREFERRED EMBODIMENTS

Figure 1:
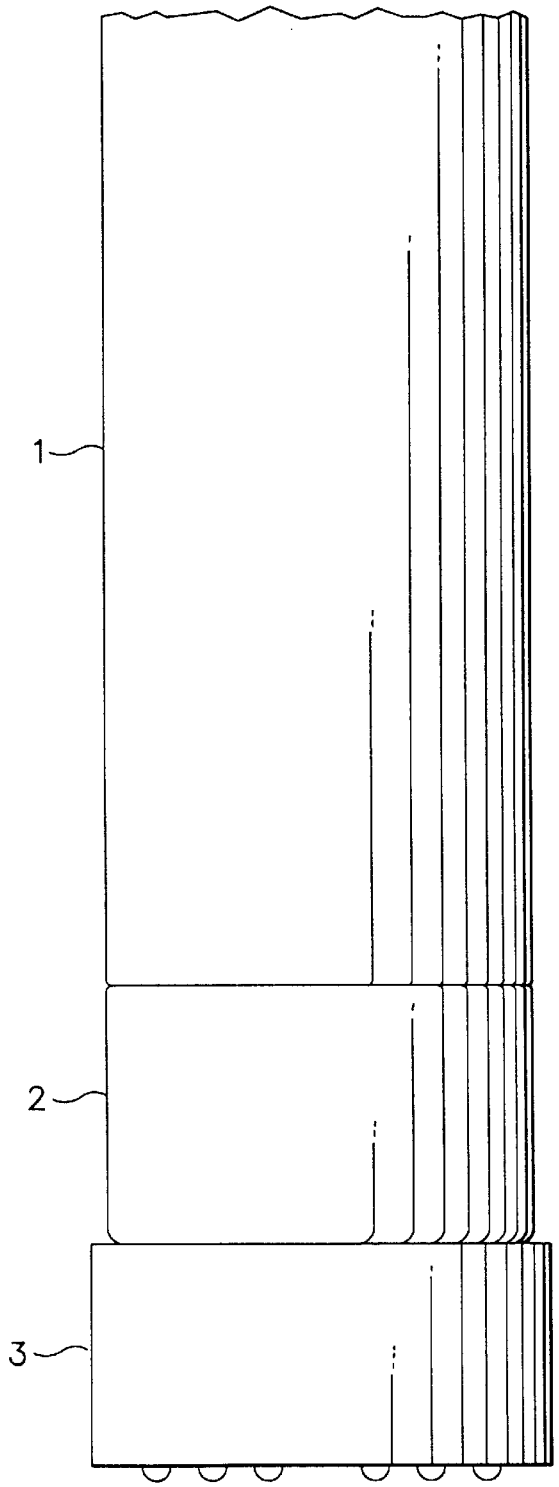
FIG. 1 is an elevational view of the lower portion of a down hole hammer assembly.

With continuing attention to the drawings, the applied reference numerals thereon indicate parts similarly identified hereafter with the reference numeral 1 indicating the barrel of a down hole hammer assembly. A drill bit chuck 2 receives a powered drill bit at 3.

Figure 2:
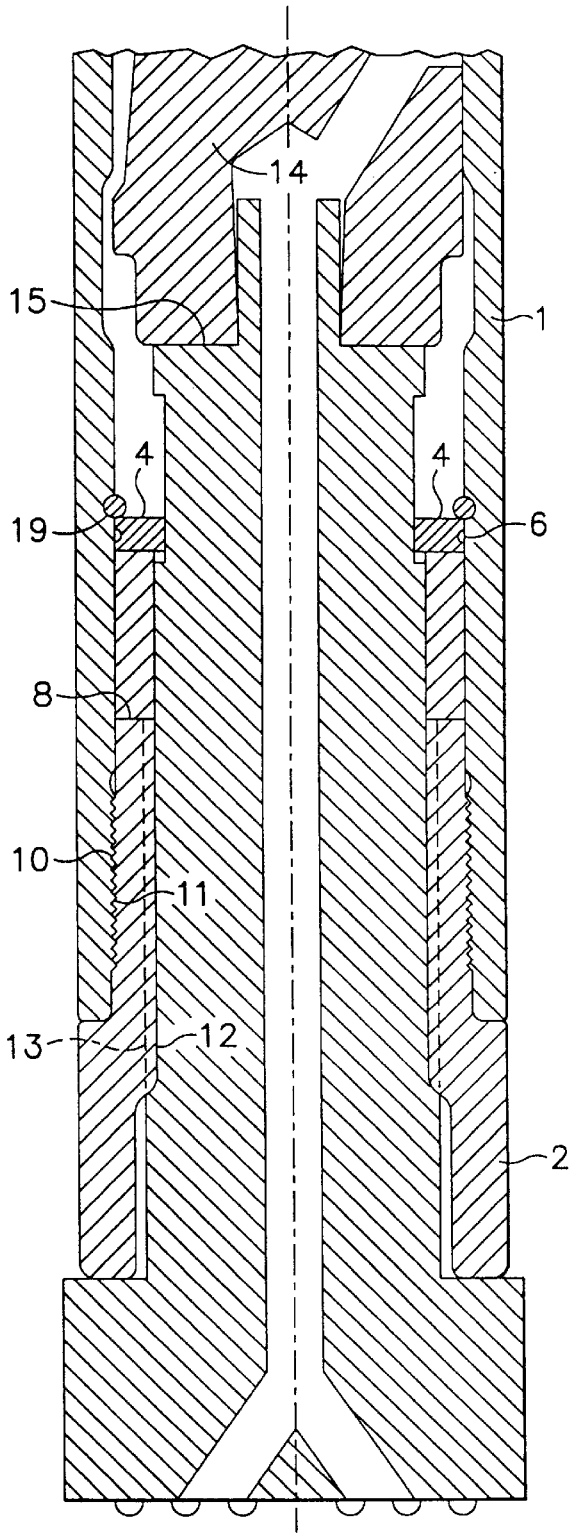
FIG.2 PRIOR ART
FIG. 2 is a vertical sectional view of a down hole hammer assembly lower portion disclosing prior art.

With attention to FIG. 2 in which prior art is shown, a split ring drill bit retainer at 4 is received within a reduced diameter segment 3A of drill bit 3 to limit the range of travel. A resilient ring member 6 extends about the segmented retainer 4 to hold same closed about the drill bit during assembly of the hammer. Split ring retainer 4 is normally supported within the lower portion of the barrel by a bearing sleeve 7 supported in place by the upper end 8 of chuck 2. A snap ring is at 19. Chuck 2 is externally threaded 10 for threaded engagement within the lower portion of the barrel 1 threaded at 11. Splines 12 and 13 are on the chuck and drill bit. A hammer 14 imparts blows to the upper end 15 of the drill bit.

In instances wherein an underreamer (not shown) is being utilized in the drilling operation it is not uncommon that counterclockwise movement is imparted to barrel 1 which results in the barrel unscrewing from the external threads 10 of chuck 2 resulting in the barrel being repositioned above split retainer ring 4 which, when resilient ring member 6 is damaged as is often the case, loss of split retainer ring 4 occurs ultimately resulting in the drill bit being left in the ground hole upon extraction of the barrel.

Figure 3:
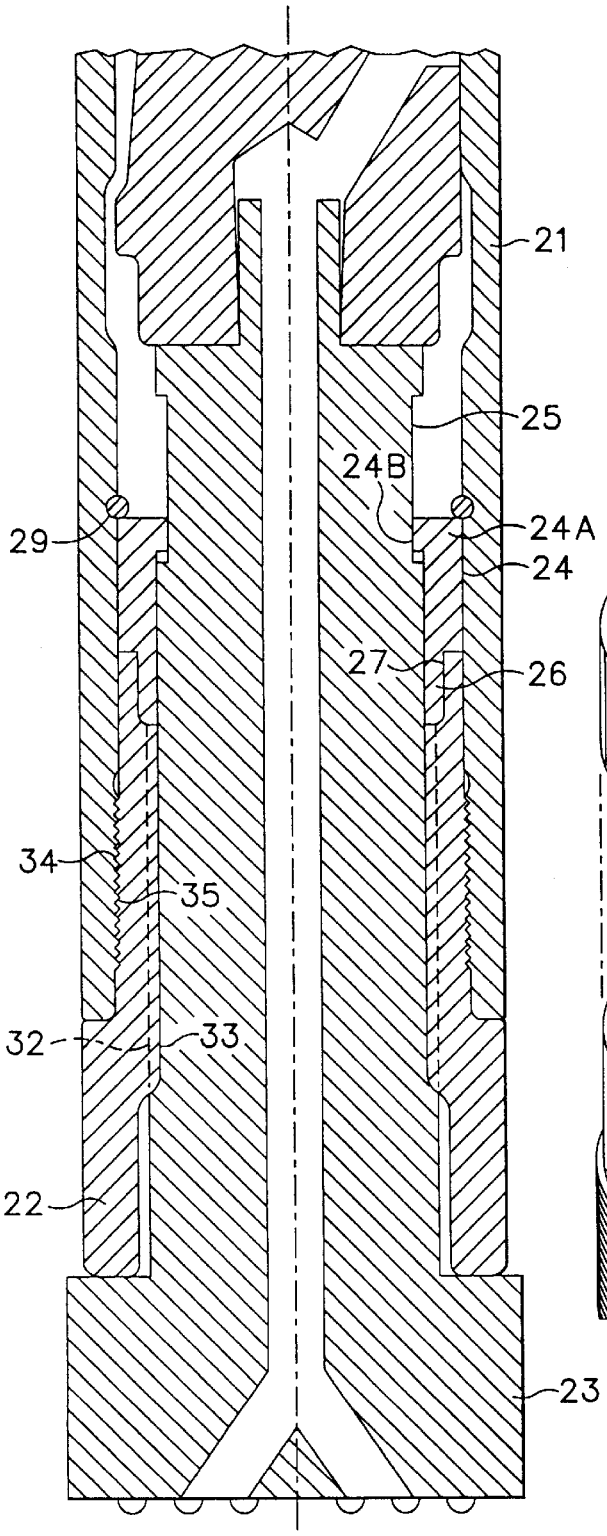
FIG. 3 is a view similar to FIG. 2 but showing an improvement embodying the present invention.
Figure 4:
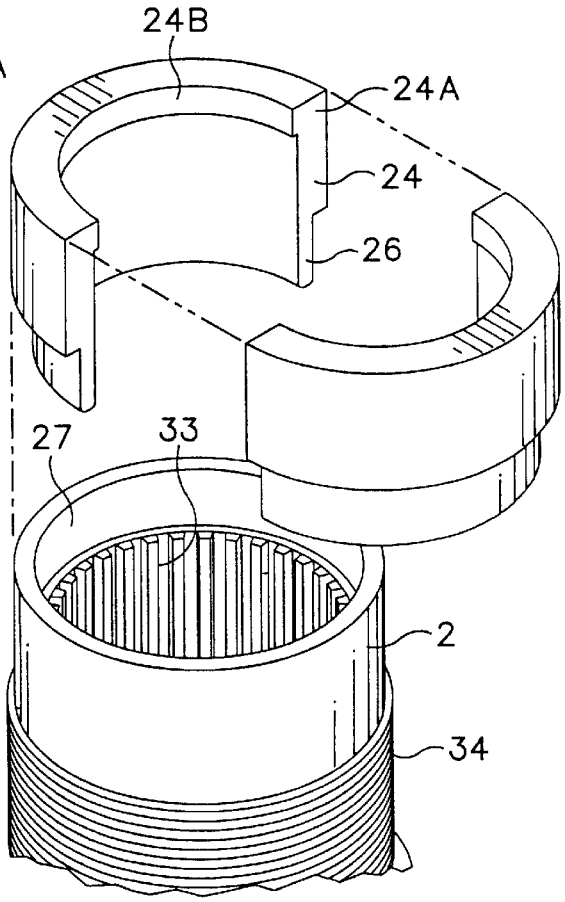
FIG. 4 is a combined perspective exploded view of a drill bit chuck with the present retainer for a drill bit.

With attention now to the present invention as best shown in FIG. 3, a barrel 21 of a ground hole hammer assembly carries a drill bit 23 slidably housed in drill bit chuck 22.

A segmented retainer sleeve is indicated at 24 and includes a ring portion 24A which seats about a reduced diameter segment 25 of drill bit 23. Ring portion 24A limits reciprocal travel of the drill bit by reason of a shoulder 24B. A skirt portion on 26 is of lesser wall thickness than said ring portion and slidably carries drill bit 23. A skirt extension 26 nests within a counterbore 27 shown formed in the upper end of drill bit chuck 22. Accordingly the retainer sleeve is confined about the bit without reliance on a resilient retainer member as was the case with the prior art arrangement earlier described. A snap ring is at 29. Bit and chuck splines are at 32–33. Chuck 22 is threaded at 34 to receive internal barrel threads at 35.

During a drilling operation, should barrel 21 become unscrewed from threads 34 of the chuck and the barrel subsequently raised to a point beyond the retainer sleeve 24, the sleeve will remain in place about the bit by reason of skirt extension 26 being radially confined. Further, should such temporary separation of barrel 21 occur, joining of the same may be reaccomplished by clockwise rotation of barrel 2 on chuck 22 to return the hammer assembly configuration shown in FIG. 3.

While FIG. 3 shows skirt 26 in engagement with the upper end of chuck 22 it will be understood that the skirt portion may be otherwise insertably engaged, as for example, with a bearing sleeve of the hammer assembly having a reduced wall thickness for skirt reception.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. In a down hole hammer having a barrel with a drill bit chuck and a drill bit slidably carried by the chuck, the improvement comprising a segmented retainer sleeve disposed about said bit and limiting axial travel of the bit, said retainer sleeve having an internal shoulder contactible with the bit and a skirt portion for inserted engagement with the drill bit chuck, said chuck having an end segment of reduced wall thickness defining an internal area for reception of said skirt portion of the retainer sleeve.

2. A down hole hammer for forming ground holes and including, a barrel, a chuck in place in said barrel, a drill bit carried by said chuck and having a segment of reduced diameter, a retainer sleeve located about said drill bit and including an internal shoulder disposed about said segment of the drill bit and limiting axial movement of the bit and a skirt portion in inserted engagement with said chuck and thereby confining the internal shoulder in place about the drill bit.

3. The down hole hammer claimed in claim 2 wherein said sleeve is of segmented construction.

* * * * *